United States Patent [19]

Mohaupt

[11] Patent Number: 4,852,647

[45] Date of Patent: Aug. 1, 1989

[54] WIRE LINE HOLD DOWN DEVICE

[76] Inventor: Henry H. Mohaupt, 1151 Estrella Dr., Santa Barbara, Calif. 93110

[21] Appl. No.: 245,527

[22] Filed: Sep. 19, 1988

Related U.S. Application Data

[63] Continuation-in-part of Ser. No. 777,360, Sep. 18, 1985, Pat. No. 4,823,876.

[51] Int. Cl.[4] ..... E21B 43/263; E21B 23/04

[52] U.S. Cl. ..... 166/63; 166/177; 166/212; 166/214

[58] Field of Search ..... 166/305.1, 308, 63, 166/297, 299, 382, 383, 385, 212, 206, 214, 311, 312, 177

[56] References Cited

U.S. PATENT DOCUMENTS

| | | | |
|---|---|---|---|
| Re. 21,444 | 5/1940 | Mayo | 102/4 |
| 156,673 | 11/1874 | Peck . | |
| 1,258,834 | 3/1918 | Waitz . | |
| 1,560,815 | 11/1925 | Hill . | |
| 2,529,763 | 11/1950 | Deputy et al. | 102/21.8 |
| 2,704,031 | 3/1955 | Taylor | 102/21.8 |
| 2,740,478 | 4/1956 | Greene | 166/63 |
| 2,790,388 | 4/1957 | MacLeod | 102/21.6 |
| 2,965,031 | 12/1960 | Johns | 166/63 X |
| 3,029,732 | 4/1962 | Greene | 166/63 X |
| 3,045,756 | 7/1962 | Briggs | 166/63 X |
| 3,342,130 | 9/1967 | Miller et al. | 102/21.8 |
| 3,630,284 | 12/1971 | Fast | 102/319 X |
| 3,912,013 | 10/1975 | Vann | 166/297 |
| 3,939,771 | 2/1976 | McReynolds | 102/21.8 |
| 4,122,899 | 10/1978 | Brieger | 166/297 |
| 4,250,960 | 2/1981 | Chammas | 166/212 X |
| 4,278,025 | 7/1981 | McReynolds | 181/116 |
| 4,329,925 | 5/1982 | Hane et al. | 102/310 |
| 4,616,703 | 10/1986 | Laurent et al. | 166/214 X |

*Primary Examiner*—Hoang C. Dang
*Attorney, Agent, or Firm*—G. Turner Moller

[57] ABSTRACT

A gas generating type fracturing tool includes a propellant charge and an ignitor for initiating combustion of the propellant. When combustion starts, a pressure buildup inside the tool manipulates a brake or drag acting against the inner casing wall to retard upward movement of the tool. A shear pin fails allowing a spring to move an element into frictional engagement with the casing string.

6 Claims, 2 Drawing Sheets

WIRE LINE HOLD DOWN DEVICE

This application is a continuation-in-part U.S. Application Ser. No. 777,360, filed Sept. 18, 1985 now Pat. No. 4,823,876.

This invention relates to a technique for stimulating a subterranean formation and more particularly to a device which employs a charge of solid propellant material which generates, during combustion, a large quantity of high pressure gases.

There are several techniques for stimulating subterranean formations. The most common technique is "hydraulic fracturing"in which a liquid is injected into a formation carrying a large quantity of sand or other proppant. The liquid is pumped into the formation so rapidly that a temporary fracture is created. The proppant is deposited in the fracture and prevents it from completely closing at the cessation of pumping. Hydraulic fracturing works quite acceptably in a large variety of situations but indisputably has its disadvantages, foremost of which is cost. Hydraulic fracturing often requires the well be killed and the tubing pulled. In addition, hydraulic fracturing uses pump trucks, proppant material and a carrier liquid, all of which are more-or-less expensive depending on a many factors.

Another technique for fracturing subterranean formations includes the detonation of an explosive charge in the well bore which fractures the formation by shattering or rubblizing. This technique is somewhat less expensive than hydraulic fracturing but has significant disadvantages. In its oldest form, explosive fracturing of a well is accomplished by placing one or more nitroglycerine charges in the well bore and then detonating them. Considerable damage is often done to casing in the well or considerable junk is left in the hole requiring significant effort to clean up the well and repair the damage done. Although more modern explosive fracturing techniques are available, these also suffer from the same disadvantages. The second disadvantage of explosive fracturing techniques involves the obvious danger in handling, transporting and detonating the explosive. Personnel of extensive training and experience are required for this technique and such are not always available.

A third type of well fracturing technique involves the use of a device incorporating a gas generating charge or propellant which is typically lowered into a well on a wire line and ignited to generate a substantial quantity of gaseous combustion products at a pressure sufficient to break down the formation adjacent the perforations. It is this type fracturing technique that this invention most nearly relates. This type fracturing differs from explosive fracturing in a number of respects: (1) fracturing is caused by high pressure combustion products produced by the propellant moving through and possibly eroding the formation rather than shock wave fracturing; and (2) the process is one of combustion rather than explosion which has numerous ramifications. For example, an explosion propagates through the explosive material by, and at the rate of, the shock wave that moves through the material. This causes explosive processes to propagate much faster than combustion, generate much higher pressures than combustion while the time for the reaction to be completed is much shorter. Typical disclosures of gas generating fracturing devices are found in U.S. Pat. Nos. 3,422,760; 3,602,304; 3,618,521; 4,064,935 and 4,081,031 along with U.S. application Ser. No. 777,360, filed Sept. 18, 1985, the disclosure of which is incorporated herein by reference.

One of the problems that has been noticed in the use of a gas generating type fracturing tool is that the wire line cable is periodically kinked or damaged after igniting a gas generating tool in a well. Once in a while, the cable acts as if it is stuck in the hole after activating one of these tools. When the cable acts as if it is stuck, there is considerable evidence to show that the cable was "bird nested" in the hole because the cable shows considerable damage such as kinking. It was originally theorized that this occurs because of upward movement of the top part of the gas generating tool during combustion thereof. Conceptually, it was thought that the propellant charge acts as if in a gun barrel pushing liquid, the cable head and cable upwardly. Instrumenting the cable head assembly has substantially proved this broad theory. Considerable upward movement of the cable head occurs during and after combustion of the propellant.

Referring to FIGS. 1 and 2, instrumentation of a standard gas generating tool shows that the pressure generated at the cable head increases rapidly from the start of ignition until about 20 milliseconds. Thereafter, pressure at the cable head declines. Peak recorded pressure probably occurs at about the time the formation begins to break down and accept significant quantities of the high pressure combustion products.

It has been discovered that there are essentially two phenomenon which cause upward movement of the tool during combustion. The first effect occurs quite rapidly, commencing almost immediately after the onset of combustion. There is almost immediately rapid acceleration of the tool and cable head assembly. In one instrumented trial, maximum acceleration of 150 g's was seen at 20 milliseconds after the ignitor was energized. By this time, the upward velocity of the cable head was measured to be 22 feet/second. The rapid acceleration of the assembly is very likely attributable to gas pressure acting on the bottom of the cable head because the maximum acceleration coincides with the maximum recorded pressure.

The maximum initial upward velocity of 22 feet/-second was maintained for about 10 milliseconds followed by a velocity decay to 13 feet/second at 50 milliseconds after ignitor actuation. This rapid deceleration of the tool must be attributed to the mass of conductor cable, because slack is introduced by the upward motion of the cable head assembly.

At 50 milliseconds, the cable head again begins to accelerate upwardly. This second upward acceleration of the tool is a much slower process and is attributed to movement of liquid in the well bore. It is believed that the liquid column in the well bore has remained almost stationary up to this point. At some time, the gas bubble created by combustion of the propellant charge begins to lift and accelerate the liquid column above it. As the liquid column begins to move, it exerts an increasing drag on the conductor cable. By 300 milliseconds, the tool has again attained an upward velocity of 22 feet/-second and has been displaced upwardly by 5 feet.

The expansion geometry of a gas bubble created by a gas generating type fracturing tool is influenced by factors such as the permeability of the formation being stimulated, the hydrostatic head of the liquid column in the well, friction losses occurring as gas and liquid move in the well and through the perforations and the overburden pressure of the earth on the formation being fractured. Extensive observations have been made concerning the conductor cable behavior and the lift experienced by the liquid column in wells treated by gas generating techniques. In summary, wells exhibiting high permeability absorb the gaseous combustion products readily whereas low permeability zones accept the combustion products at much lower rates causing a substantial quantity of the evolved gas to remain in the well bore resulting in excessive lift of the liquid column. It is possible to at least partially offset this deficiency by increasing the hydrostatic head of liquid in the well bore.

Notwithstanding this partial solution, the conductor cable experiences potentially damaging upward motion and loss of tension which may result in kinking, separation of strands of the stranded cable and, in more severe cases, bird nesting of the cable in the well bore and jamming of the sheave wheel at the well head.

The obvious solution to preventing upward movement of the top of a gas generating type fracturing tool and cable head is to provide a hold down device which engages the well casing in some fashion to maintain tension in the wire line. It turns out that this general approach has been suggested for use in various facets of the oil field. For example, U.S. Pat. Nos. 2,529,763; 2,704,031; 3,342,130 and 3,939,771 disclose a variety of techniques for anchoring a seismic charge in a hole drilled in the earth. Devices which appear similar are found in U.S. pat. Nos. 156,673 and 1,560,815 which are used in conjunction with oil well torpedoes. Hold down devices for perforating guns are found in U.S. pat. Nos. 2,965,031 and 4,122,899. In U.S. pat. No. 2,965,031, the hold down device is manipulated by a separate explosive charge. In U.S. pat. NO. 4,122,899, the hold down device is manipulated in response to movement of a perforating gun. A hold down for a nitroglycerine type explosive charge for use in a well is shown in U.S. pat. RE21,444. Miscellaneous disclosures are found in U.S. pat. Nos. 1,258,824; 2,790,388; 3,912,013; 4,278,025 and 4,329,925.

It is possible to actuate a hold down mechanism prior to the initiation of combustion of the propellant charge in order to retard upward movement of the tool. An additional explosive charge, ignited by direct current of a first polarity down the conductor cable, could be followed by ignition of the propellant charge through a diode by direct current of the opposite polarity down the conductor cable. Although these type techniques are widely used in perforating guns to accomplish sequential downhole operations, they inherently complicate the tool and potentially lead to accidents, malfunctions and embarrassments.

One of the problems with a mechanical hold down mechanism, particularly one that has moving parts, in the environment of gas generating fracturing tools, is that pressures of substantial magnitude are generated for quite short periods of time. Because the pressures generated are so high, it is clear that sturdy mechanisms of substantial strength are required. Because the elapsed time of a typical gas generating charge is so short, usually on the order of 10–200 milliseconds, it was originally thought that the inertia of mechanical hold down devices would prevent them from being moved from a stowage position to an operative position if that movement were to occur in response to the tool going off.

Despite the fact that burning of the propellant charge is over in a very short time, instrumentation of the tool has shown that movement of the tool upwardly in the casing string is much slower. Upward acceleration occurs very rapidly and a typical upward velocity of 20 feet/second or so is reached in about 20 milliseconds. But the actual amount of movement that occurs in this interval is very small because the elapsed time is so short. Thus, it may take 80–100 milliseconds for a typical tool to have moved upwardly one foot. Exactly how much upward movement is necessary to cause bird nesting of the cable is unknown but experience shows that very small displacements of the cable do not cause bird nesting. Thus, there is more time available to actuate a mechanical hold down device in response to initiation of combustion than had previously been thought.

The device of this invention comprises a carrier for a charge of propellant material and an ignitor for initiating combustion of the propellant in response to an electrical signal transmitted down the conductor cable or wire line. Means are provided to retard upward movement of the tool comprising an element for frictionally engaging the inner wall of the casing string. The frictional element is biased for movement from a first stowed or retracted position to a second extended position in engagement with the casing wall. A holding device or trigger holds the element in the first position but is released by the buildup of pressure in or adjacent the tool. In one embodiment, a piston is moveably mounted in a cylinder and held in place by a shear pin. The piston is exposed to pressure buildup in the carrier and, in response thereto, develops a force sufficient to shear the pin. The piston is then freed for movement and releases the frictional element.

It is accordingly an object of this invention to provide a hold down mechanism for a gas generating type fracturing tool.

Another object of this invention is to provide a hold down mechanism for a gas generating fracturing tool which acts in response to pressure buildup adjacent the tool.

Other objects and advantages of this invention will become more fully apparent as this invention proceeds, reference being made to the accompanying drawings and appended claims.

IN THE DRAWINGS

Figure 3:
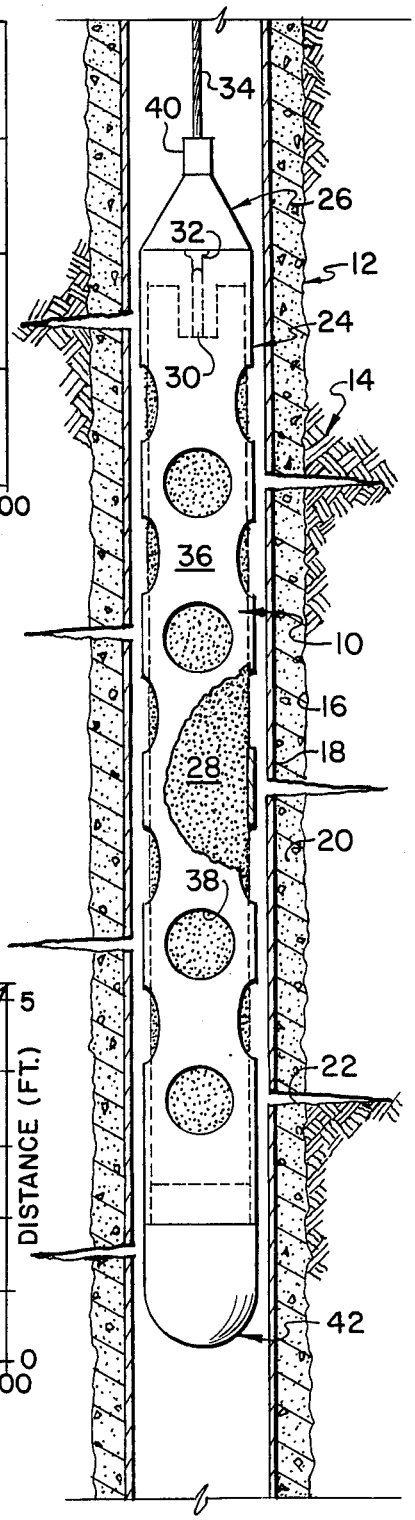
FIG. 3 is a longitudinal cross-sectional view of a gas generating tool this invention.
Figure 4:
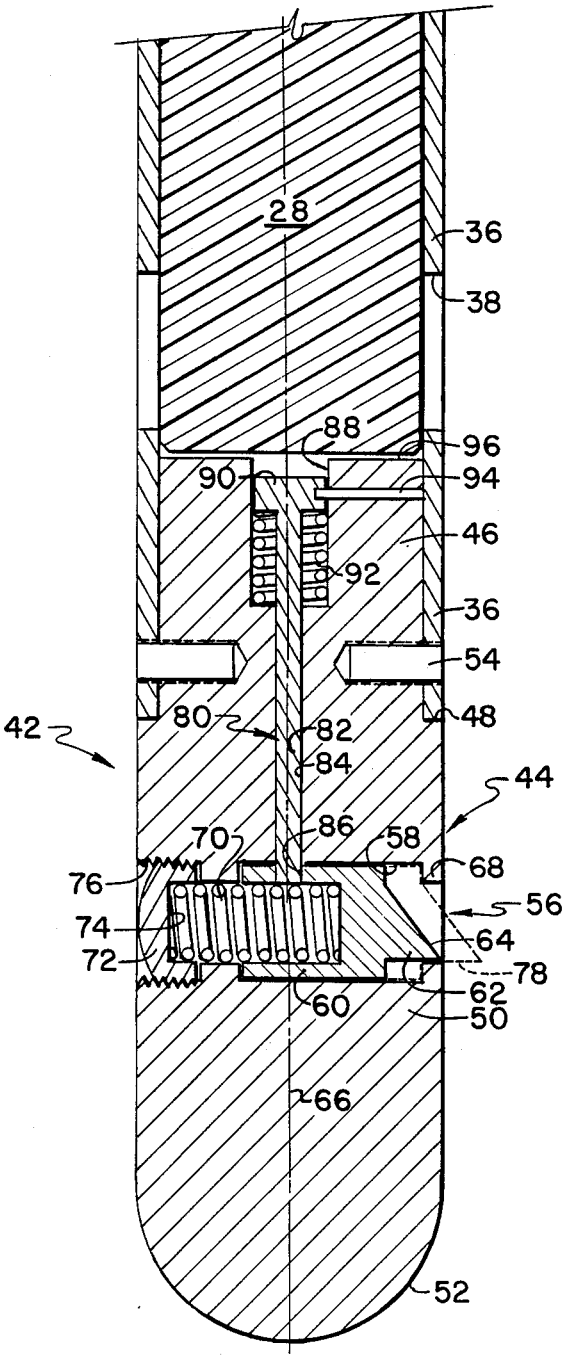
FIG. 4 is an enlarged longitudinal cross-sectional view of the gas generating tool of FIG. 3, illustrating the hold down mechanism of this invention.

Referring to FIGS. 3 and 4, there is illustrated a gas generating tool 10 lowered inside a well 12 which penetrates a formation 14 to be fractured. The well 12 includes a bore hole 16 and a casing string 18 cemented in the bore hole 16 by a cement sheath 20. A multiplicity of perforations 22 have been formed between the formation 14 and the interior of the casing string 18 as is customary in the art.

The gas generating tool 10 comprises a frame or carrier 24 connected to a cable head assembly 26 and receiving a charge 28 of propellant material. An ignitor 30 includes a pair of wires 32 connected to a conductor cable or wire line 34. The wire line 34 acts to suspend the tool 10 in the well 12 and to deliver an electrical signal through the wires 32 to activate the ignitor 30 thereby initiating combustion of the propellant change 28.

The carrier or frame 24 comprises an elongate rigid metallic tubular member or housing 36, open at both ends, having many laterally facing openings 38 arranged symmetrically along the tubular member. The openings 38 comprise a series of staggered openings spaced longitudinally along the tubular member 36. Typically, the housing 36 has a wall thickness on the order of $\frac{1}{4}$-$\frac{3}{8}$". The carrier 24 is open to liquids in the casing string 18. In addition, the openings 38 allow the gaseous high pressure combustion products to escape from the propellant charge 28 with minimum restrictions. The cable head 26 may include a collar locator 40 to facilitate positioning of the tool 10 at a desired location, as is well known in the art.

The propellant charge 28 contains a fuel and an oxidizer. The fuel is conveniently in a resin form polymerized into a unit. Typically, the oxidizer components are water soluble. In this event, the resin polymer is preferably of a water insoluble type so that the liquid in the well 12 does not attack the propellant charge 28. In the alternative, the propellant charge 28 may be painted so it is not attacked by well fluids. Because the propellant 28 is inside the tubular housing 36, there is no danger of the charge 28 bowing and thereby becoming stuck inside the casing 18 or tubing through which it may be run.

The ignitor 30 may be conventional and includes a section of thin wall aluminum tubing (not shown) having gun powder or other fast burning material therein. When the ignitor 30 is energized through the wires 32, it combusts thereby raising the temperature of the propellant 28 adjacent thereto. This causes the propellant 28 to begin burning thereby liberating high pressure gaseous combustion products through the openings 38. Those skilled in the art will recognize the tool 10, as heretofore described, to be typical of gas generating type fracturing tools.

To minimize undesirable upward movement of the tool 10 in the well 12, there is provided a drag 42 for retarding upward movement of the carrier 24 after the onset of combustion of the propellant 28. The drag 42 comprises a carrier or housing 44 having an upper end 46 of reduced diameter received in the open bottom of the tool housing 36, a shoulder 48 abutting the bottom edge of the tool housing 36, an elongate lower section 50 and a rounded lower end 52. The housing 44 is removably connected to the tool housing 36 by one or more threaded fasteners 54.

The drag 42 also comprises an element 56 mounted for movement in a passage 58 of the carrier 44 between a retracted position shown in solid lines in FIG. 4 and an extended position shown in dashed lines in frictional engagement with the interior wall of the casing string 18. The element 56 includes a hollow cylindrical body 60 closed by a forward end 62 having a casing engaging face 64 inclined to the tool axis 66. Movement of the element 56 toward the casing string 18 is limited by a shoulder 68. Thus, movement of the element 56 is constrained to a distance such that the diameter of the lower section 50 plus the travel of the element 56 out of the carrier 44 is slightly greater than the internal diameter of the casing string 18.

A helical spring 70 fits in the open rear of the element 56 and abuts a cap screw 72 having a recess 74 on its inner end. The cap screw 72 is advanced into a threaded opening 76 coaxial with the passage 58. Thus, the element 56 is normally biased by the spring 70 toward engagement with the casing string 18.

The shape of the inclined face 64 of the element 56 allows essentially one way travel in the casing string 18 because the element 56 advances into the gap in a conventional oil field threaded coupling and the shoulder 78 prevents a downward force on the carrier 44 from retracting the element 56. Thus, the element is normally held in the retracted position by a trigger or release mechanism 80.

The trigger 80 comprises a vertical rod 82 extending through a vertical passage 84 in the carrier 44. The passage 84 intersects the passage 58 and the rod 82 fits into an opening or recess 86 in the cylindrical body 60. The upper end of the rod 82 extends into an enlarged open top passage 88 in the upper end of the carrier 44. The passage 88 is thus open to pressure generated by the propellant 28 after the onset of combustion.

A piston 90 is connected to the upper end of the rod 82 and fits in the passage 88 to react to pressure in the tool housing 36. A spring 92 biases the piston 90 upwardly along the tool axis 66 and a shear pin 94 restrains the piston 90 until a predetermined pressure is generated in the tool housing 36.

Operation of the drag 42 is now apparent. As the tool 10 is run into the well 12, the frictional element 56 is in a retracted position out of engagement with the casing string 18. When the ignitor 30 is actuated, combustion of the propellant 28 begins thereby raising the pressure in or adjacent the tool 10. Because the passage 88 is open to pressure generated by the tool 10, a force is created on the piston 90. At a predetermined pressure, a force is created which shears the pin 94. This predetermined pressure is selected to be a value approaching the maximum generated pressure in the well 10, for example 2500 psi above the hydrostatic pressure adjacent the formation 14.

Figure 1:
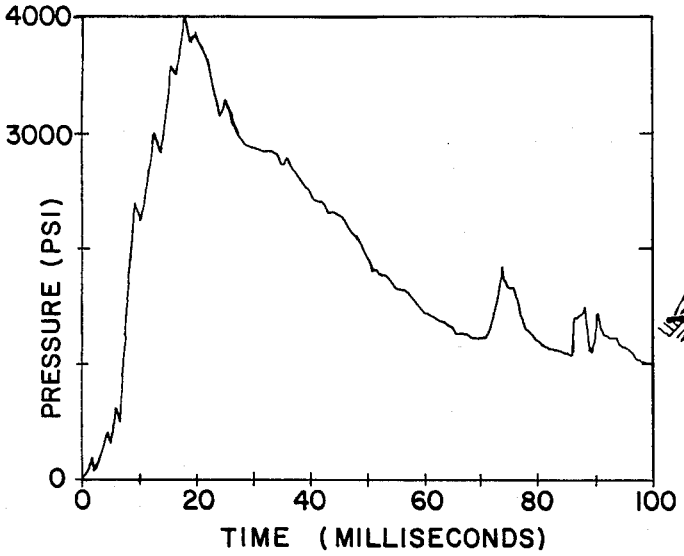
FIG. 1 is a graph showing the pressure-time relationship of a typical gas generating tool.
Figure 2:
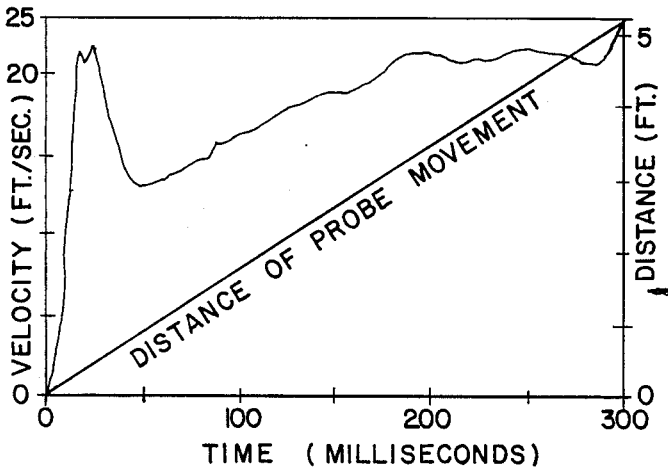
FIG. 2 is a chart showing the relationship of velocity, distance moved and time of a conventional prior art unrestrained gas generating tool.

When the pin 94 shears, the piston 90 initially moves down against the spring 92. The spring 92 is selected to be strong enough so that when the pressure in the well 10 begins to decline from the predetermined value, the spring 92 moves the piston 90 up thereby moving the rod 82 out of engagement with the body 60 thereby allowing the spring 70 to move the element 56 into frictional engagement with the casing string 18. As the tool 10 moves up, as shown in FIG. 2, the element 56 engages the inside of the casing string 18 and acts as a brake or drag to retard further upward movement. After the gas generating fracturing process is complete, the tool 10 is withdrawn upwardly in the well 12 by winding the wire line 34 about a cable drum (not shown) on a conventional wire line or perforating truck as is conventional in the art. The drag 42 continues to retard upward movement, but is not enough to prevent winding the wire line 34 on the cable drum and removing the tool 10 from the well 12.

There is evidence to suggest that the drag 42 does not begin to operate until combustion of the propellant 28 is over. This may be due to the spring 92 not overcoming the pressure in the carrier 36 until later than expected. One cause of this is that the bottom of the propellant 28 may act as a better seal against the top face 96 of the carrier 44 than anyone imagines. This restricts gas flow into the passage 88 and reduces the rate of pressure buildup seen by the piston 90. The propellant 28 tends to burn from the top down even though the ignitor 30 attempts to initiate radial combustion. This may prolong any tendency of the propellant 28 to seal against the face 96.

Figure 5:
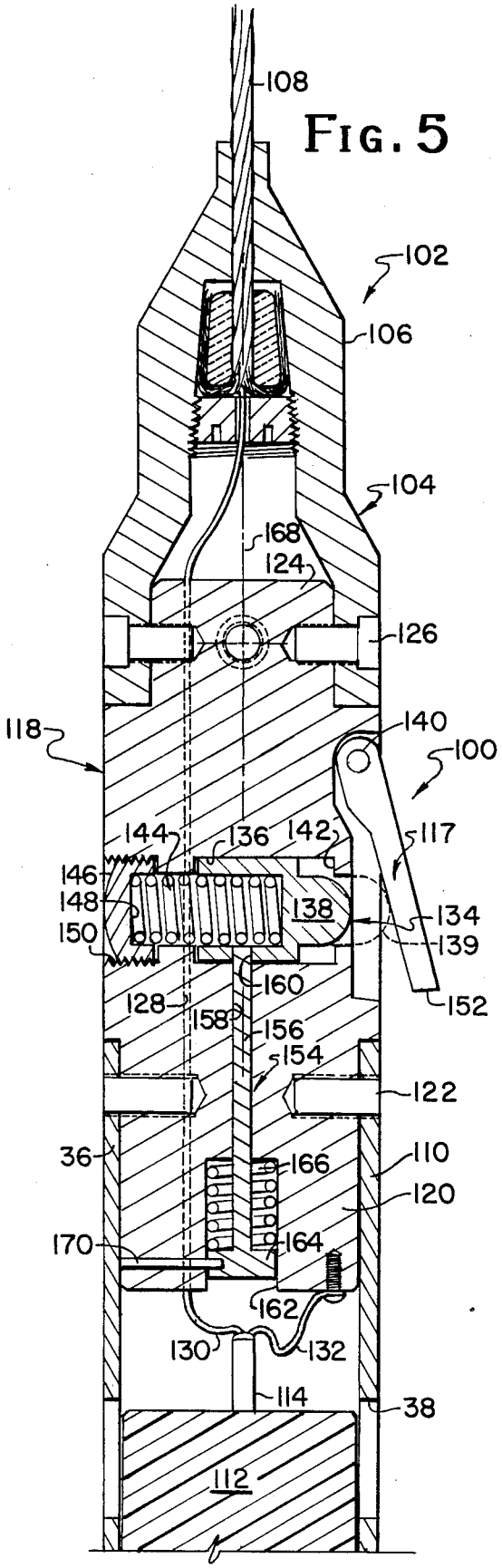
FIG. 5 is an enlarged longitudinal cross-sectional view of another gas generating tool, illustrating another hold down mechanism of this invention.

As shown in FIG. 5, a drag 100 is provided on the upper end of a gas generating tool 102 as part of the cable head assembly 104 below the rope socket 106 to which the wire line 108 is attached and above the housing 110 which contains a propellant charge 112 and an ignitor 114. The drag 100 is quite similar to the drag 42 and differs in only two respects. First, there are a series of changes dictated by the different placement of the drag 100 on the tool 102. Second, the casing engaging member 117 is slightly different.

The carrier or housing 118 of the drag 100 comprises a lower end 120 of reduced diameter received in the open upper end of the tool housing 110 and is connected thereto by suitable threaded fasteners 122. An upper section 124 of the housing 118 is of reduced diameter, is received in the open bottom of the cable head assembly 104 and is connected thereto by suitable threaded fasteners 126. A suitable passage 128 allows a wire 130 to connect between the cable 108 and the ignitor 114. A ground wire 132 leads from the ignitor 114 to the housing 118.

The drag 100 comprises an element 134 mounted for movement in a passage 136 of the carrier 118 between a retracted position shown in solid lines in FIG. 5 and an extended position shown in dashed lines. The element 134 includes a hollow cylindrical body 138 closed by a hemispherical forward end 139 abutting the casing engaging member 117 for pivoting it about its mounting pin 140 into frictional engagement with the casing string. Movement of the element 134 outwardly limited by a shoulder 142. Thus, movement of the element 134 is constrained to a distance such that the diameter of the carrier 118 plus the travel of the free end of the lever or casing engaging member 117 is slightly greater than the internal diameter of the casing string into which the tool 100 is run.

A helical spring 144 fits in the open rear of the element 134 and abuts a cap screw 146 having a recess 148 on the inner end thereof. The cap screw 146 is advanced into a threaded opening 150 coaxial with the passage 136. Thus, the spring 144 normally biases the element 134 and lever 117 toward engagement with the casing string.

The shape of the end 152 of the lever 117 allows essentially one way travel in the casing string because the end 152 advances into the gap in a conventional oil field threaded coupling and prevents a downward force on the carrier 118 from retracting the element 134. Thus, the element 134 is normally held in the retracted position by a trigger or release mechanism 154.

The trigger 154 comprises a vertical rod 156 extending through a vertical passage 158 in the carrier 118. The passage 158 intersects the passage 136 and the rod 156 fits into an opening or recess 160 in the cylindrical body 138. The lower end of the rod 156 extends into an enlarged open bottomed passage 162 in the lower end of the carrier 118. The passage 162 is accordingly open to pressure generated by the propellant 112. A piston 164 is connected to the lower end of the rod 156 and fits in the passage 162 to react to pressure in the tool housing 110. A spring 166 biases the piston 164 down along the tool axis 168 and a shear pin 170 restrains the piston 164 from moving until a predetermined pressure is generated in the tool housing 110.

Operation of the drag 100 is now apparent. As the tool 102 is run into a well, the element 134 and lever 117 are in their retracted position out of engagement with the casing string. When the ignitor 114 is actuated, combustion of the propellant 112 begins thereby raising the pressure in or adjacent the tool 102. Because the passage 162 is open to the generated pressure, a force is created on the piston 164. As the pressure increases, a force is created which is sufficient to shear the pin 170. This pressure is selected to be a value approaching the maximum generated pressure in the well, for example 2500 psi above the hydrostatic pressure adjacent the formation being fractured.

When the pin 170 is sheared, the piston 162 initially moves up against the spring 164. The spring 164 is selected to be strong enough so that when the pressure in the well begins to decline, the spring 166 moves the piston 162 down thereby moving the rod 156 down out of engagement with the cylindrical body 136 thereby allowing the spring 144 to move the element 134 outwardly to move the lever 117 into frictional engagement with the casing string. As the tool 102 moves up, the lever 117 engages the interior of the casing string and acts as a brake or drag to retard further upward movement. After the gas generating fracturing process is complete, the tool 102 is withdrawn from the well by winding the wire line 108 about a cable drum (not shown) on a conventional wire line or perforating truck as is conventional in the art. The drag 100 continues to retard upward movement, but is not sufficient to prevent winding the wire line 108 on the cable drum and removing the tool 102 from the well.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. Apparatus for fracturing a subterranean formation penetrated by a casing string, comprising a carrier having means for connecting to a wire line, a propellant supported by the carrier for generating a large quantity of high pressure gaseous combustion products and an ignitor for initiating combustion of the propellant in response to an electric signal delivered down the wire line; and means for retarding upward movement of the carrier after the onset of combustion of the propellant including an element on the carrier movable from a first retracted position out of engagement with the casing string to a second extended position for engagement with the casing string;

means maintaining the element in the first position and then releasing the element for movement toward the second position in response to a pressure buildup adjacent the carrier comprising a frame providing a cylindrical passage therein exposed to the pressure buildup adjacent the carrier, a piston in the passage movable from a first position corresponding to the first position of the element and a second position releasing the element, a shear pin holding the piston in a first position and means interconnecting the piston and the element for holding the element in the first position until movement of the piston to the second position thereof; and means moving the element toward the second position after the element is released for movement.

2. The apparatus of claim 1 wherein the element comprises a generally vertically oriented elongate member having an upper end and a lower end and means pivoting the elongate member to the carrier at the upper end thereof, the lower end being movable into engagement with the casing string.

3. The apparatus of claim 1 wherein the apparatus comprises a longitudinal tool axis and the element comprises a member arranged transverse to the tool axis having an outer end exposed to the casing string.

4. The apparatus of claim 1 wherein the carrier includes an elongated longitudinal axis and the frame comprises a passage transverse to the axis and wherein the maintaining means comprises an actuator in the passage including a spring for biasing the element from the first position toward the second position and a follower abutting the spring and abutting the element.

5. The apparatus of claim 4 wherein the piston comprises a rigid extension interfitting with the actuator and preventing the actuator from moving until the shear pin is broken.

6. The apparatus of claim 5 wherein the pressure buildup adjacent the carrier tends to move the piston in a first direction and further comprising a spring biasing the piston in a second direction opposite to the first direction, movement of the piston in the second direction acting to move the rigid extension out of interfitting engagement with the actuator.

* * * * *